US007992235B2

(12) United States Patent
Booth

(10) Patent No.: US 7,992,235 B2
(45) Date of Patent: Aug. 9, 2011

(54) UTILITY SINK

(75) Inventor: Shawn J. Booth, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 397 days.

(21) Appl. No.: 12/100,785

(22) Filed: Apr. 10, 2008

(65) Prior Publication Data

US 2009/0255052 A1 Oct. 15, 2009

(51) Int. Cl.
*A47J 47/20* (2006.01)

(52) U.S. Cl. ..... 4/656

(58) Field of Classification Search ..... 4/639–642, 4/619, 656, 654; 220/23.88, 23.86, 23.83; 68/232, 233
See application file for complete search history.

(56) References Cited

U.S. PATENT DOCUMENTS

| | | | | |
|---|---|---|---|---|
| 62,082 | A | 2/1867 | Smith | |
| 253,989 | A | 2/1882 | Dennison | |
| 327,747 | A * | 10/1885 | Wines | 68/214 |
| 477,137 | A | 6/1892 | Mesick | |
| 1,102,412 | A | 7/1914 | James | |
| 1,188,680 | A | 6/1916 | Rhonemus | |
| 1,240,037 | A | 9/1917 | Ellis | |
| 1,338,486 | A | 4/1920 | Burdick | |
| 1,763,174 | A | 6/1930 | Morris | |
| 1,842,289 | A | 1/1932 | Russel | |
| 2,457,038 | A | 12/1948 | Garonis | |
| 2,591,467 | A | 4/1952 | Rodefer | |
| 3,253,435 | A | 5/1966 | Berk et al. | |
| 4,033,461 | A | 7/1977 | Nevai | |
| 4,336,620 | A * | 6/1982 | Gresh | 4/639 |
| 5,136,736 | A * | 8/1992 | Bishop | 4/641 |
| 5,715,547 | A | 2/1998 | Becker et al. | |
| 6,173,455 | B1 | 1/2001 | Nordstrom | |
| 6,248,982 | B1 * | 6/2001 | Reid et al. | 219/429 |
| 6,341,704 | B1 | 1/2002 | Michel | |
| 6,427,259 | B1 | 8/2002 | Cawthon | |
| 6,467,105 | B1 | 10/2002 | Vanden Elzen | |
| 6,560,791 | B2 * | 5/2003 | Perucchi | 4/642 |
| 6,886,191 | B2 | 5/2005 | Zolotnik | |
| 6,925,964 | B2 | 8/2005 | Jeffery | |

FOREIGN PATENT DOCUMENTS

| | | |
|---|---|---|
| DE | 452774 | 11/1927 |
| FR | 1191772 | 10/1959 |

OTHER PUBLICATIONS

Nine pages of a PCT search report of PCT/US2009/002215 dated Jul. 20, 2009 in a corresponding PCT application.
15" Stainless Steel Pro Cooksink, Kohler Professional catalog, p. 166, admitted prior art, published at least as early as Apr. 9, 2007.

* cited by examiner

*Primary Examiner* — Gregory L Huson
*Assistant Examiner* — Janie Christiansen
(74) *Attorney, Agent, or Firm* — Quarles & Brady LLP

(57) ABSTRACT

A utility sink system is disclosed comprising a sink and a bucket. The sink has a basin extending from an upper edge to a drain. The bucket has walls extending to a lip and has at least one opening formed therein. The lip is configured to contact the upper edge of the basin such that the bucket is suspended in the basin. The at least one opening of the bucket, in addition to facilitating handling, may provide a form of overflow when the bucket is suspended in the basin of the sink, such that the at least one opening places an interior volume of the bucket and the basin of the sink in communication with one another. Further, the at least one opening of the bucket may provide a pouring spout.

9 Claims, 8 Drawing Sheets

FIG. 8
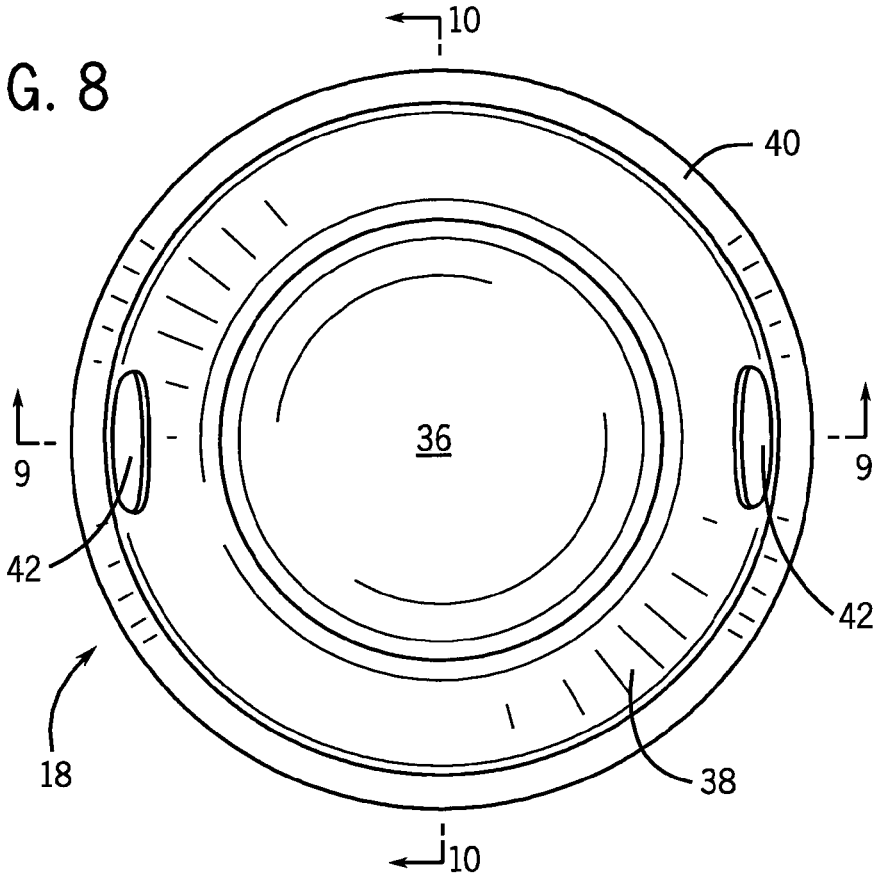
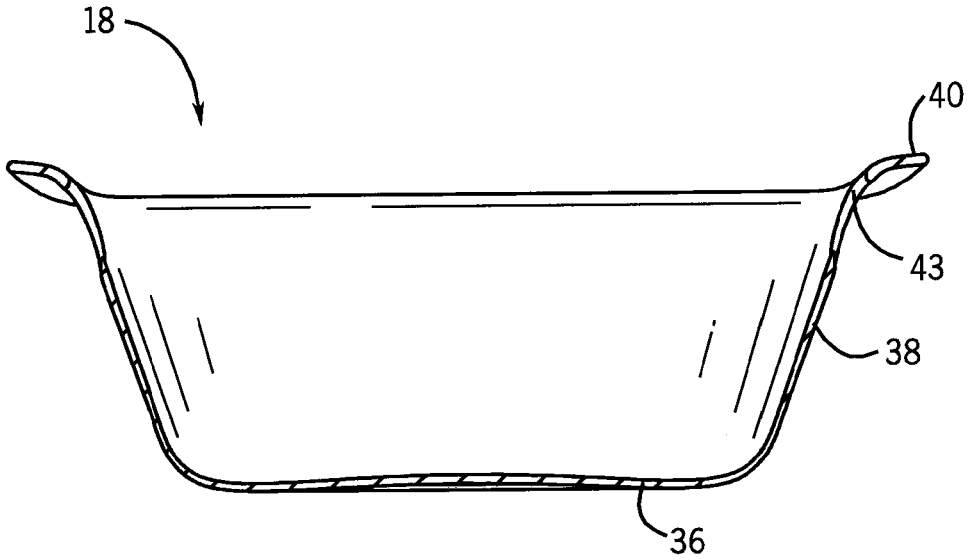
FIG. 9

UTILITY SINK

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to sinks. In particular, this invention relates to utility sinks such as laundry sinks.

Although many clothes are laundered using modern washing machines and dryers, some types of fabrics still require hand washing. Although washtubs for hand washing fabrics were once commonplace, it is now rather rare for individuals to have a dedicated washtub. Thus, most hand washing, if not performed by a professional cleaner, is done using an available sink.

Typically, hand washing of clothes and other fabrics is performed by plugging the available sink, filling the sink with water of an appropriate temperature, adding cleaner, and allowing the fabrics to soak. After scrubbing the clothes, the sink is drained and the clothes are rinsed. The clothes may then be wrung out and hang dried.

However, it can be inconvenient to commit a sink to washing clothes and fabrics since this renders the sink temporarily inaccessible for other uses such as, for example, the washing of hands or other items. As many utility sinks are used for a variety of purposes, surface of the sink can become soiled. Particularly when these substances are oily or could stain the clothes, it may be undesirable to use an all-purpose sink for hand washing.

Hence, a need exists for improved means of hand washing fabrics. In particular, there is a need for a better way to hand wash fabrics that does not require the use of antiquated devices, such as washtubs.

SUMMARY OF THE INVENTION

The present invention provides a utility sink comprising a sink and a bucket. The sink has a basin extending from an upper edge to a drain. The bucket has walls extending to a lip and has at least one opening formed in a side portion of the walls. The lip is configured to selectively contact the upper edge of the basin such that the bucket is suspended in the basin. The at least one opening of the bucket, in addition to facilitating handling, provides a form of overflow when the bucket is suspended in the basin of the sink, such that the at least one opening places an interior volume of the bucket and the basin of the sink in communication with one another.

Additionally, the bucket may have a structure conducive to the openings performing as pour spouts. The side portion of the walls may extend from a base portion of the walls at a non-right angle. The at least one opening may be located on the walls proximate a radiused transition between the side portion of the walls and the lip. Thus, the at least one opening may located on a non-vertical plane that promotes pouring out of the handles at relatively low angle of tilt for the bucket.

Further, a portion of the lip may raises around the at least one opening in the bucket such that the at least one opening is accessible from between the sink and the bucket. In this way, the bucket may be removed or lifted from the sink in an ergonomic manner.

According to one aspect of the invention, when the bucket is suspended from the upper edge of the sink, the lip covers at least half of the upper edge. Additionally, a rack can be placed on a floor of the basin to cover the drain and may further support the bucket.

The present invention can further include a shallow tray having an outer rim that selectively mates with the lip of the bucket. The shallow tray can have at least one opening formed therein. When the shallow tray mates with the lip of the bucket, the at least one opening of the shallow tray can nest over the at least one openings of the bucket. The shallow tray may include a plurality of holes formed therein. The shallow tray may also include a central larger hole that facilitates the hanging of the shallow tray between uses.

According to another aspect of the invention a utility sink is provided comprising a sink, a rack, a bucket, and a shallow tray. The sink has a basin extending from an upper edge to a drain. The rack is placed on a floor of the basin such that the rack covers the drain. The bucket has walls extending to a lip and having at least one opening. A side portion of the walls is angled away from a base portion of the bucket. The at least one opening is located on the walls proximate a radiused transition between the side portion of the walls and the lip. Accordingly, the at least one opening is not located on a vertical plane. Further, a portion of the lip is raised around the at least one opening in the bucket. The shallow tray has an outer rim that selectively mates with the lip of the bucket. The at least one opening of the bucket, in addition to facilitating handling, provides a form of overflow when the bucket is positioned in the basin of the sink and filled with water. This overflow is possible because the at least one opening places an interior volume of the bucket and the basin of the sink in communication with one another Thus, the present invention provides a utility sink for the hand washing of fabrics that has a removable bucket. When the bucket is suspended above the basin of the sink, the bucket can be filled with water for the hand washing of clothes. The bucket openings place the interior volume of the bucket with the basin such that when the water level in the bucket exceeds the height of the openings, the water in the bucket overflows into the basin and can flow down the drain.

Moreover, once the bucket is filled with water, the bucket can be temporarily removed from the basin of the sink to make the sink available for other uses while hand washing, soaking, and the like of clothes is performed in the bucket. Then, the bucket may either be returned to the sink, or one of the openings may be used as a pour spout to empty the water contained in the bucket back into the sink to drain.

When the bucket is suspended above the basin, this configuration also provides a form of overflow rinsing. The clothes to be rinsed are placed in the bucket which is suspended in the basin. Water from a faucet fills the bucket until the water begins to overflow from the openings of the bucket into the basin. The continual flow of water into and out of the bucket rinses the clothes contained the bucket. Because the clothes do not cover the drain, the chance that the drain will be blocked during rinsing is minimalized. Thus, clothes can be rinsed without close observation by the cleaner.

These and still other advantages of the invention will be apparent from the detailed description and drawings. What follows is merely a description of a preferred embodiment of the present invention. To assess the full scope of the invention the claims should be looked to as the preferred embodiment is not intended to be the only embodiment within the scope of the claims.

BRIEF DESCRIPTION OF THE DRAWINGS

FIG. 8 is a top plan view of the bucket;

FIG. 9 is a cross-sectional side view of the bucket along line 9-9 of FIG. 8;

DETAILED DESCRIPTION OF THE PREFERRED EMBODIMENT

Figure 1:
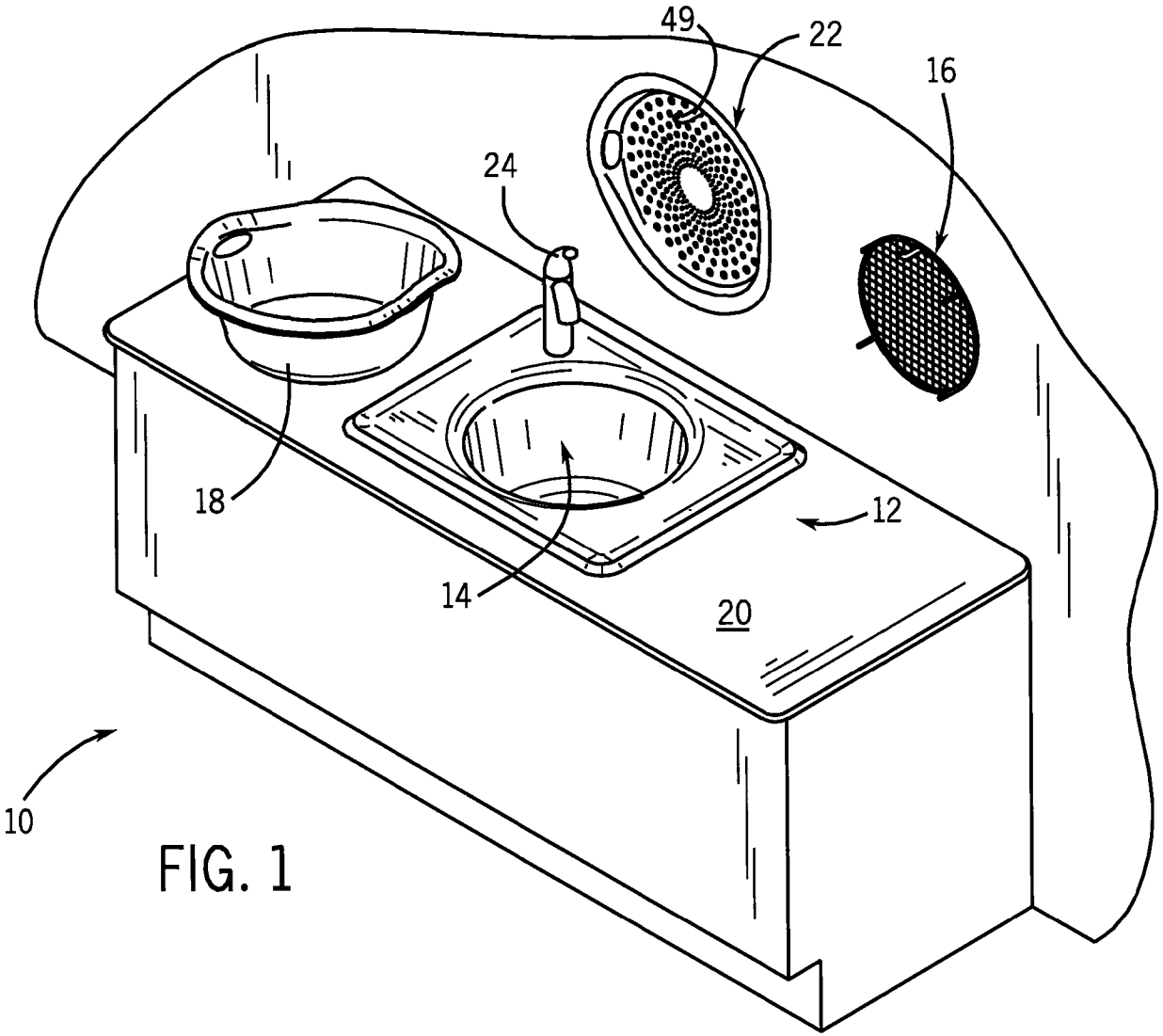
FIG. 1 is a perspective view of a utility sink with a bucket, a shallow tray, and a base tray shown removed from the sink.

Referring now to FIG. 1, the utility sink 10 is shown which includes a sink 12 with a basin 14, a rack 16 (shown hung on a wall in FIG. 1), a bucket 18 (shown on a countertop 20 in FIG. 1), and a shallow tray 22 (shown hung on the wall in FIG. 1). A faucet 24 that provides water extends over the sink 12.

Figure 4:
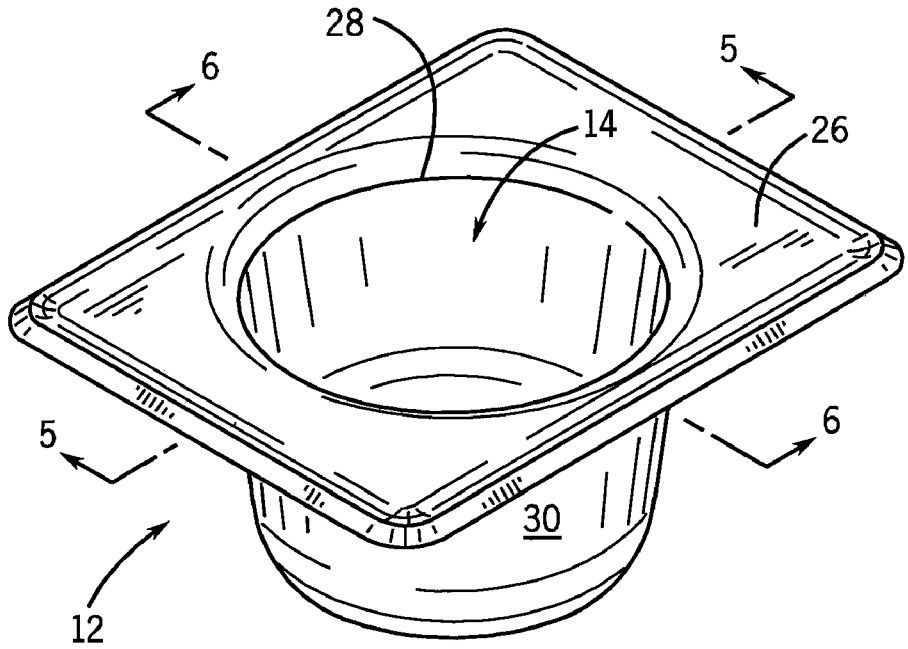
FIG. 4 is a perspective view of the sink.
Figure 5:
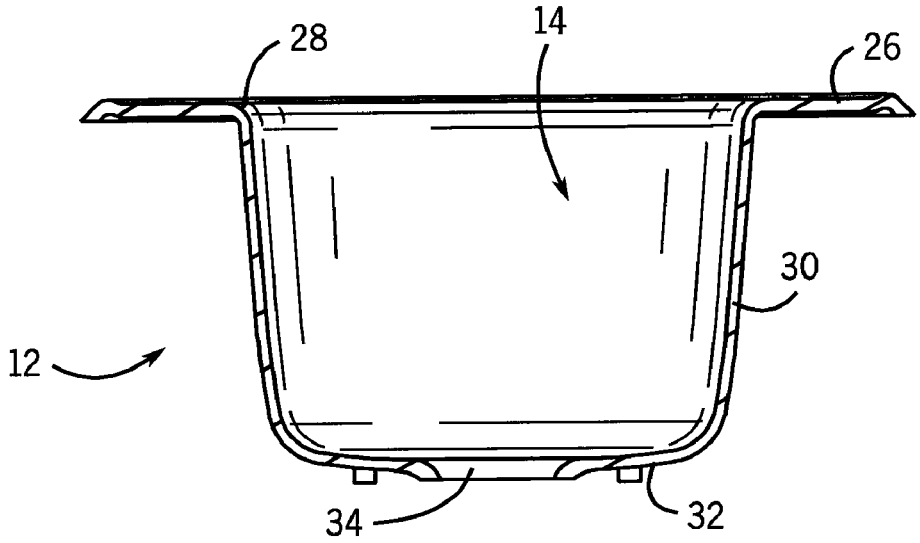
FIG. 5 is a cross-sectional side view of the sink taken along line 5-5 of FIG. 4.
Figure 6:
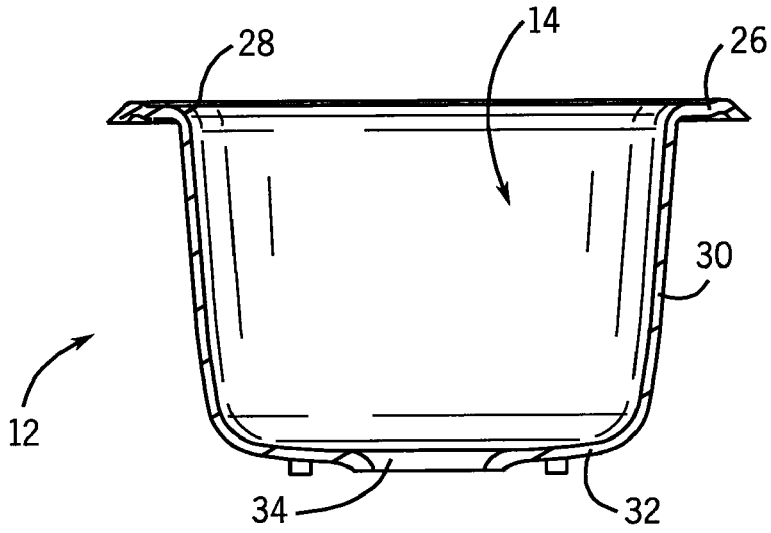
FIG. 6 is a cross-sectional side view of the sink along line 6-6 of FIG. 4.
Figure 7:
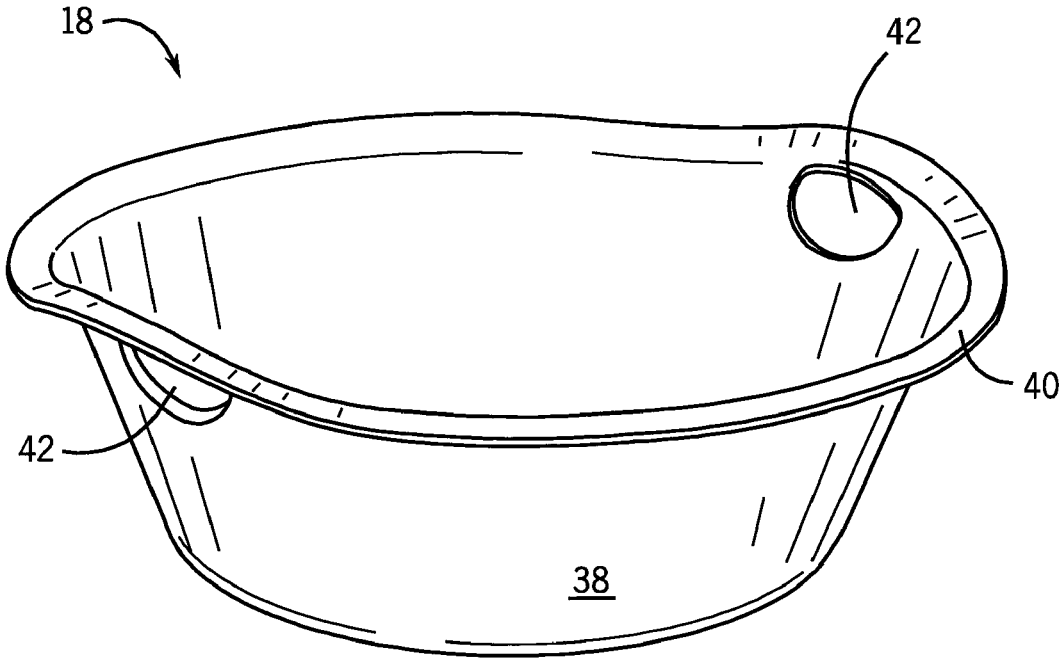
FIG. 7 is a perspective view of the bucket.
Figure 10:
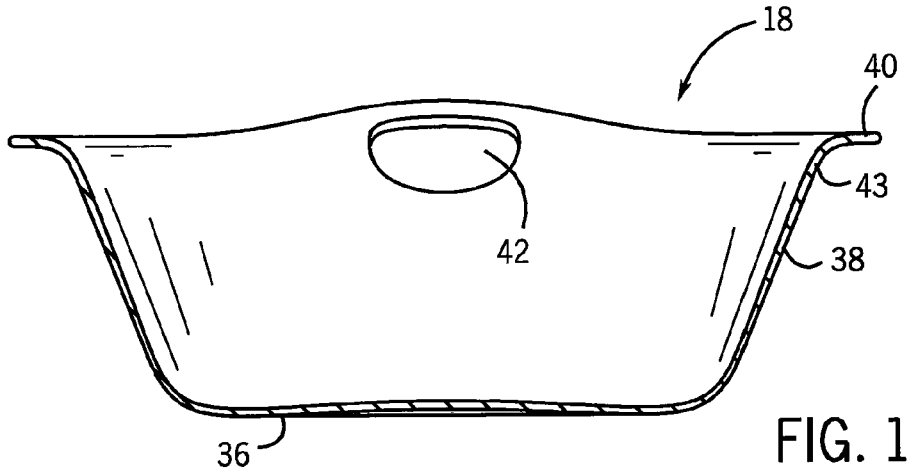
FIG. 10 is another cross-sectional side view of the bucket along line 10-10 of FIG. 8.
Figure 11:
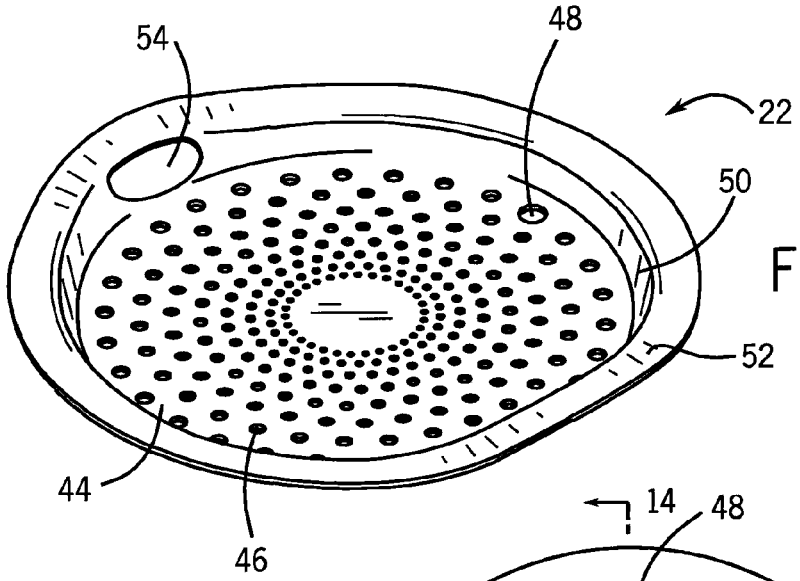
FIG. 11 is a perspective view of the shallow tray.
Figure 12:
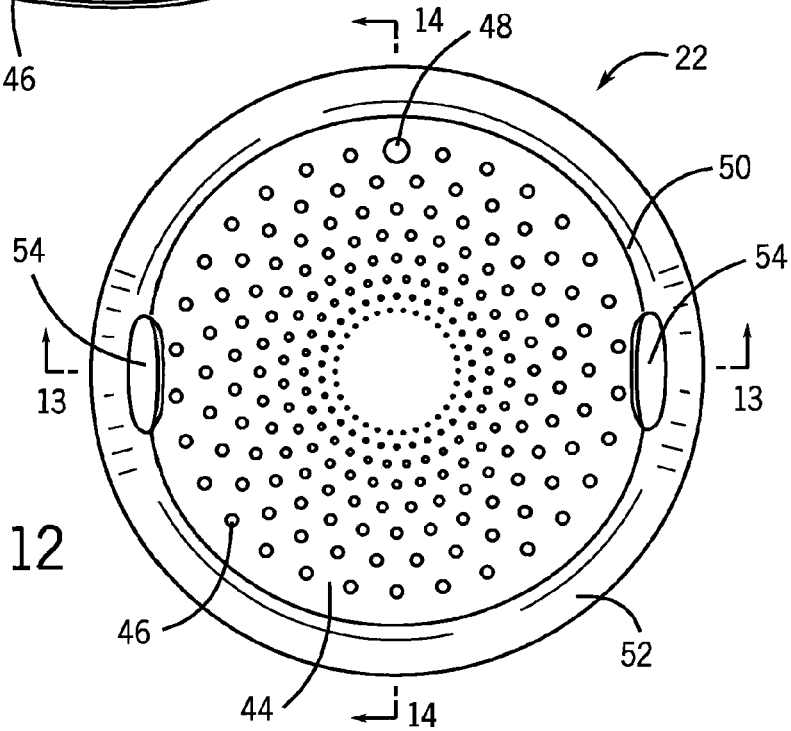
FIG. 12 is a top plan view of the shallow tray.
Figure 13:
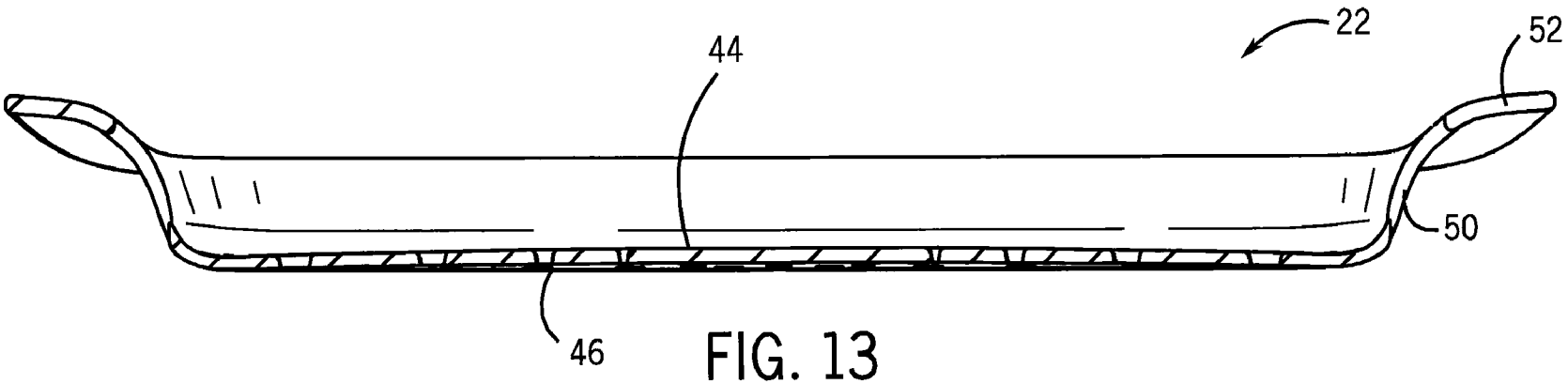
FIG. 13 is a cross-sectional side view of the shallow tray along line 13-13 of FIG. 12.
Figure 14:
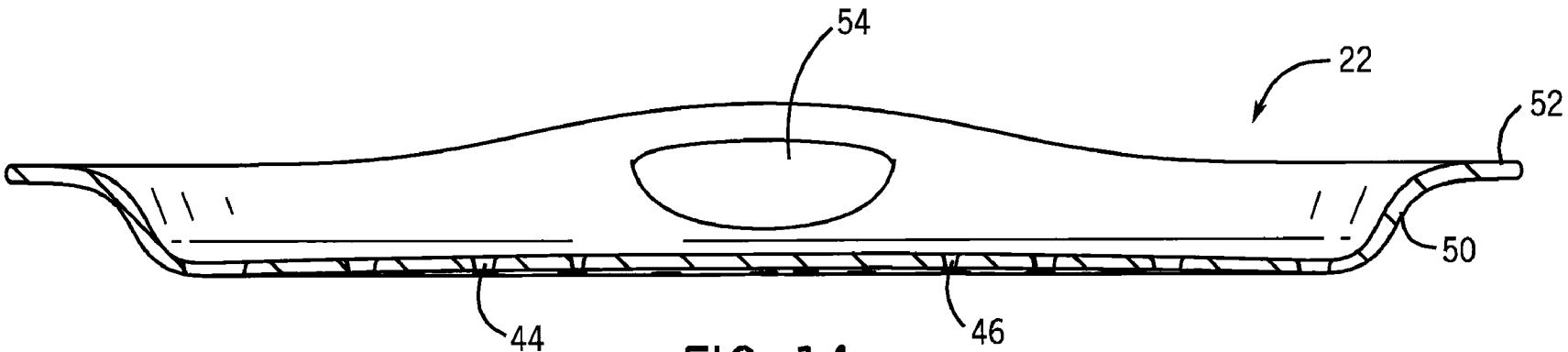
FIG. 14 is another cross-sectional side view of the shallow tray along line 14-14 of FIG. 12.

Referring now to FIGS. 4-6, the sink 12 has a flanged portion 26 that extends from the basin 14. As shown, the flanged portion 26 of the sink 12 is rectangular with rounded corners. The flanged portion 26 may assist in supporting the sink 12 in the countertop 20. The flanged portion 26 and the basin 14 meet an upper edge 28 of the basin 14. The upper edge 28 provides a radiused transition between the flanged portion 26 and the basin 14. The basin 14 then extends down along side walls 30 to a base 32 of the sink 12. The base 32 of the sink 12 has a drain 34 which can be connected to a waste water pipe (not shown).

As the side walls 30 basin 14 extend from the upper edge 28 down towards the base 32 and the drain 34, they angle slightly inward (i.e., towards the drain). Likewise, the base 32 angles slightly downward to the drain 34. This geometry encourages any water filling the basin 14 to be directed towards the drain 34.

Referring now to FIGS. 7-10, further details of the bucket 18 are shown. The bucket 18 has walls including a base portion 36 and side portion 38 extending to a lip 40. The side portion 38 angle outward from the base portion 36. The side portion 38 have a transition 43 into the lip 40. The walls have at least one opening 42 formed therein. As shown, the bucket 18 has two such openings formed proximate the transition 43 spanning the side portion 38 of the walls and the lip 40.

Figure 2:
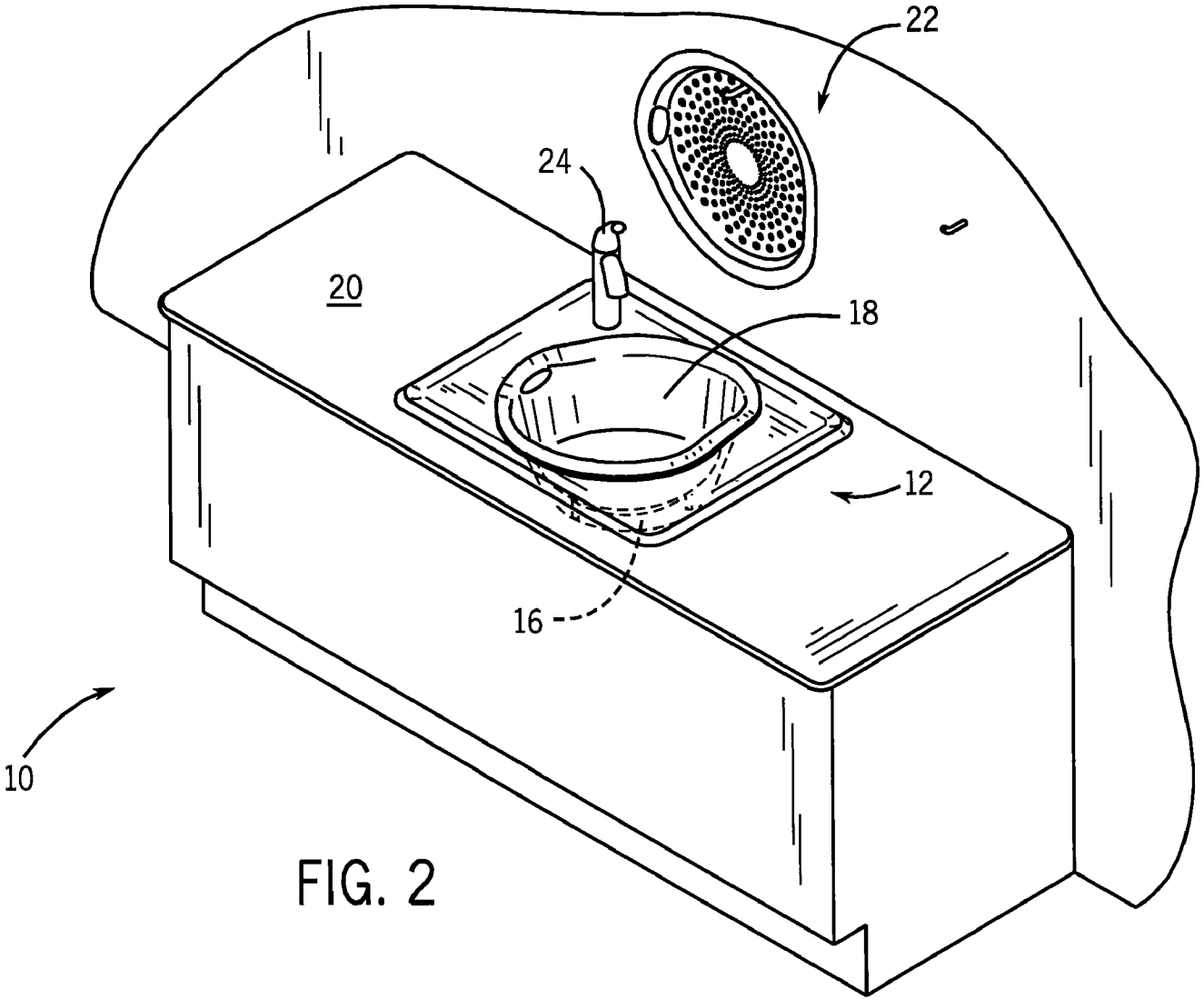
FIG. 2 is a perspective view of the utility sink with the bucket positioned in the basin of the sink.

Referring now to FIGS. 11-14, the shallow tray 22 is shown in further detail. The shallow tray 22 has a flat portion 44 having a plurality of holes 46. The flat portion 44 can also include a large hole 48 that may be suitable for hanging the shallow tray 22 from a hook 49, such as is shown in FIGS. 1 and 2, so that the shallow tray 22 can be dried. The flat portion 44 has short side walls 50 that extend to an outer rim 52. At least one opening 54 is formed in the shallow tray 22. As shown, the shallow tray 22 has two openings 54 formed in the short side walls 50 and outer rim 52.

Referring back to FIG. 2, the utility sink 10 is shown with the rack 16 inserted into the bottom of the sink 12 and the bucket 18 received in the basin 14. In this arrangement, the lip 40 of the bucket 18 contacts the upper edge 28 of the basin 14 of the sink 12 to suspend the bucket 18 in the basin 14. It is contemplated that in some configurations, the lip 40 may cover at least half of the upper edge 28 of the basin 14.

The rack 16 may provide additional support for the bucket 18, particularly if the bucket 18 is filled with water. Further, the rack 16 covers the drain 34. The rack 16 has a structure that permits water to flow past the rack 16 and down the drain 34, but will prevent items such as clothing from clogging the drain 34. For example, the rack 16 may have a mesh surface similar to the shallow tray 22 or be a wire tray.

It is also contemplated that the bucket 18 may not be suspended in the basin 14, but rather solely supported by the rack 16. Such a configuration would require constructing the rack 16 and bucket 18 such that for a given sink depth, the lip 40 of the bucket does not engage the upper edge 28 of the sink 12. In such an arrangement, it is contemplated that as the openings 42 would still be in the basin 14, that the openings 42 could still perform an overflow function and, as the bucket 18 sits on the rack 16 so that the bucket does not block the drain 34, the overflow water would be permitted to flow down the drain 34.

Importantly, when the bucket 18 is suspended in the basin 14 (or placed on a rack 16 in the basin 14), the openings 42 of the bucket 18 place the inner volume of the bucket 18 and the basin 14 in fluid communication with one another. Thus, when the bucket 18 is filled with water by the faucet 24 and the water level in the bucket 18 reaches the openings 42, the excess water overflows through the openings 42 and into the basin 14 of the sink 12.

It should be appreciated that in addition to providing overflow capabilities, the openings 42 of the bucket 18 may serve as a pouring spout. This may be beneficial when the bucket 18 is filled with water, the clothes and cleaner are placed in the bucket 18, and left to soak outside of the basin 14. When the water in the bucket 18 needs to be emptied, the bucket 18 may be tilted such that the water runs out of one of the openings 42. The openings 42 may be formed on a non-vertical surface for surface to easy pouring. For example, if the openings 42 are formed on the angled side portion 38 of the walls as shown, it reduces the angle at which the bucket 18 must be tilted before pouring action begins (i.e., the water level will more quickly approach the openings 42 when the side portion 38 of the walls are angled).

Further the openings 42 of the bucket 18 can serve as handles for lifting the bucket 18. In one form, the lip 40 is raised around the openings 42 such that, when the lip 40 contacts the upper edge 28 of the basin 14, the openings 42 can be accessed from between the bucket 18 and the sink 12. This provides an ergonomic structure for lifting as the fingers of the individual lifting the bucket 18 from the sink 12 can go into the openings 42 from the outside, rather than the inside, of the bucket 18.

Figure 3:
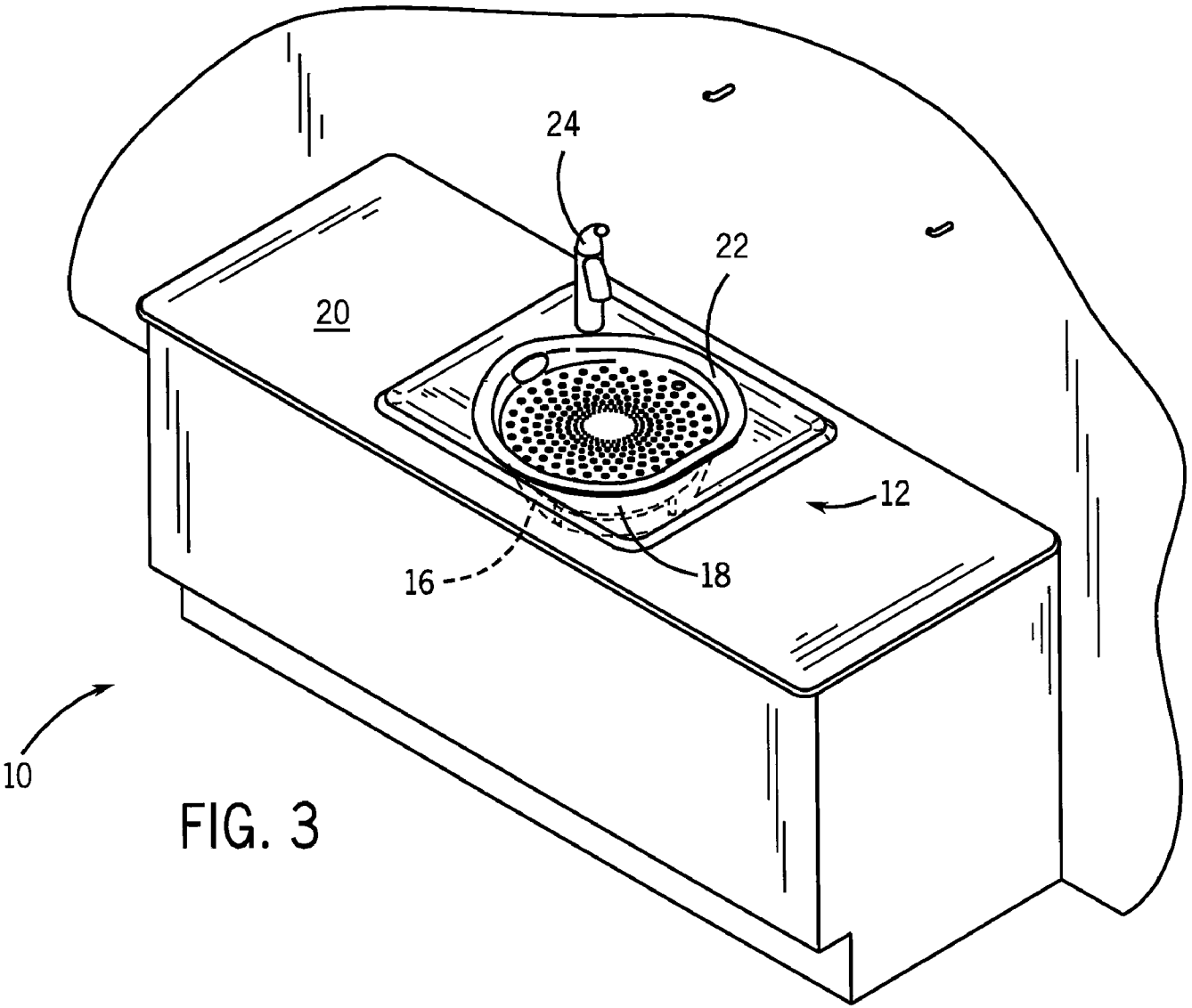
FIG. 3 is a perspective view of the utility sink with the bucket positioned in the basin of the sink and the shallow tray placed over the bucket.

Referring now to FIG. 3, the utility sink 10 of FIG. 2 is shown with the shallow tray 22 further placed on top of the bucket 18. The outer rim 52 of the shallow tray 22 may mate with the lip 40 of the bucket 18. In this arrangement, the openings 54 of the shallow tray 22 may nest or partially nest in the openings 42 of the bucket 18. This arrangement makes it easy to lift both the bucket 18 and the shallow tray 22 at the same time. When using the openings 42 as a pouring spout, it is also contemplated that the outer rim 52 of the shallow tray 22 may be held against the lip 40 of the bucket 18, such that pouring can occur out of unobstructed openings 42 while retaining any solid items, such as clothing, in the bucket.

The shallow tray 22 may also be used as a scrubbing surface during the hand washing of fabrics. In particular, the plurality of holes 46 located in the flat portion 44 provides a surface with sufficient abrasion for scrubbing while also permitting the water to pass through it. It is contemplated that scrubbing may occur when the shallow tray 22 is mated to the lip 40 of the bucket 18 or when the shallow tray is separated from the bucket 18.

Thus, the present invention provides a utility sink that can be used to hand wash clothes or other fabric items. As the bucket 18 can be suspended in the basin 14, hand washed clothes are less likely to come into contact with contaminants found on the inner surface of a basin 14 of the sink 12. Moreover, since the bucket 18 can be removed from the sink 12 during soaking, the utility sink 10 can be used for other operations while the clothes are being soaked.

Although the present invention has been described with reference to washing clothes, it is contemplated that the utility sink may be useful any application in which it is desirable to have a bucket that can be suspended by, but is also removable from, a basin.

Many modifications and variations to this preferred embodiment will be apparent to those skilled in the art, which will be within the spirit and scope of the invention. Therefore, the invention should not be limited to the described embodiment. To ascertain the full scope of the invention, the following claims should be referenced.

INDUSTRIAL APPLICABILITY

The invention provides a utility sink for the hand washing of clothing.

What is claimed is:

1. A utility sink comprising:

a sink having a basin extending from an upper edge to a drain, with the sink having a flange extending outward from the upper edge of the basin; and a bucket for holding water, the bucket having walls extending to a lip and having at least one opening formed in a side portion of the walls, the lip being configured to contact the basin adjacent the upper edge of the basin such that the bucket is suspended in the basin, wherein the lip is raised around the opening such that even though the bucket is so suspended in the basin the opening is still accessible from between the sink and bucket so as to act as a handle to facilitate removal of the bucket from the sink;

wherein the at least one opening of the bucket, in addition to facilitating handling, provides a form of overflow when the bucket is suspended in the basin of the sink, such that the at least one opening places an interior volume of the bucket and an interior of the basin of the sink in communication with one another; and wherein the side portion of the walls extend from a base portion of the walls and the at least one opening is located on the walls proximate a transition between the side portion of the walls and the lip, such that the at least one opening is located on a non-vertical plane and the lip is configured to act as a pouring spout.

2. The utility sink of claim 1 wherein, when the bucket is suspended from the upper edge of the sink, the lip covers at least half of the upper edge.

3. The utility sink of claim 1 further comprising a rack placed on a floor of the basin to cover the drain.

4. The utility sink of claim 1 wherein a portion of the lip raises around the at least one opening in the bucket such that the at least one opening is accessible from between the sink and the bucket for removing the bucket from the sink.

5. A utility sink comprising:

a sink having a basin extending from an upper edge to a drain, with the sink having a flange extending outward from the upper edge of the basin; and a bucket for holding water, the bucket having walls extending to a lip and having at least one opening formed in a side portion of the walls, the lip being configured to contact the basin adjacent the upper edge of the basin such that the bucket is suspended in the basin, wherein the lip is raised around the opening such that even though the bucket is so suspended in the basin the opening is still accessible from between the sink and bucket so as to act as a handle to facilitate removal of the bucket from the sink;

wherein the at least one opening of the bucket, in addition to facilitating handling, provides a form of overflow when the bucket is suspended in the basin of the sink, such that the at least one opening places an interior volume of the bucket and an interior of the basin of the sink in communication with one another; and wherein the side portion of the walls extend from a base portion of the walls at a non-right angle and the at least one opening is located on the walls proximate a transition between the side portion of the walls and the lip, such that the at least one opening is located on a non-vertical plane and the lip is configured to act as a pouring spout;

wherein the sink further comprises a shallow tray having an outer rim that selectively mates with the lip of the bucket, the shallow tray having at least one opening formed therein such that when the shallow tray mates with the lip of the bucket the at least one opening of the shallow tray can be aligned to nest over the at least one opening of the bucket so that the bucket and shallow tray may both be readily lifted at the same time using the openings.

6. The utility sink of claim 5 wherein the bucket and the shallow tray each have two openings.

7. The utility sink of claim 5 wherein the shallow tray includes a surface having a plurality of holes formed therein to thereby provide a combined scrubbing and drainage surface.

8. The utility sink of claim 7 wherein the shallow tray includes a central larger hole that facilitates hanging of the shallow tray between uses.

9. A utility sink comprising:

a sink having a basin extending from an upper edge to a drain;

a rack placed on a floor of the basin such that the rack covers the drain;

a bucket having walls extending to a lip and having at least one opening, a side portion of the walls being angled away from a base portion of the bucket, the at least one opening being located on the walls proximate a transition between the side portion of the walls and the lip, such that the at least one opening is not located on a vertical plane and a portion of the lip raising around the at least one opening in the bucket and is configured to act as a pouring spout; and a shallow tray having an outer rim that selectively mates with the lip of the bucket;

wherein the at least one opening of the bucket, in addition to facilitating handling, provides a form of overflow when the bucket is positioned in the basin of the sink and filled with water, such that the at least one opening places an interior volume of the bucket and an interior of the basin of the sink in communication with one another;

wherein the shallow tray further comprises at least one opening formed therein such that when the shallow tray mates with the lip of the bucket the at least one opening of the shallow tray can be aligned to nest over the at least one opening of the bucket such that these openings can act as a combined handle for both the tray and bucket so that the bucket and shallow tray may both be readily lifted at the same time using the openings.

* * * * *